US006148635A

United States Patent [19]

Beebe et al.

[11] Patent Number: 6,148,635

[45] **Date of Patent: *Nov. 21, 2000**

[54] ACTIVE COMPRESSOR VAPOR COMPRESSION CYCLE INTEGRATED HEAT TRANSFER DEVICE

[75] Inventors: David Beebe, Savoy; Clark Bullard, Urbana; Michael Philpott, Seymour; Mark Shannon, Champaign, all of Ill.

[73] Assignee: The Board of Trustees of the University of Illinois, Urbana, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/174,813

[22] Filed: Oct. 19, 1998

[51] Int. Cl.[7] ..... F28B 1/00

[52] U.S. Cl. ..... 62/498; 62/259.2; 165/80.2; 417/322; 417/413.3

[58] Field of Search ..... 62/498, 115, 118, 62/324.6, 259.2; 165/80.2; 417/322, 412, 413.1, 413.2, 413.3, 474

[56] References Cited

U.S. PATENT DOCUMENTS

| | | | |
|---|---|---|---|
| 4,392,362 | 7/1983 | Little | 62/514 R |
| 5,078,581 | 1/1992 | Blum et al. | 417/322 |
| 5,083,194 | 1/1992 | Bartilson . | |
| 5,094,594 | 3/1992 | Brennan | 417/322 |
| 5,099,311 | 3/1992 | Bonde et al. . | |
| 5,166,775 | 11/1992 | Bartilson . | |
| 5,192,197 | 3/1993 | Culp | 417/322 |
| 5,457,956 | 10/1995 | Bowman et al. . | |
| 5,611,214 | 3/1997 | Wegeng et al. | 62/498 |
| 5,725,363 | 3/1998 | Bustgens et al. | 417/413.3 |
| 5,759,014 | 6/1998 | Van Lintel et al. | 417/413.3 |
| 5,759,015 | 6/1998 | Van Lintel et al. | 417/322 |
| 5,836,750 | 11/1998 | Cabuz | 417/322 |

FOREIGN PATENT DOCUMENTS

| | | |
|---|---|---|
| 1522000 | 11/1989 | U.S.S.R. . |
| 1603155 | 10/1990 | U.S.S.R. . |
| 9800869 | 1/1998 | WIPO . |

OTHER PUBLICATIONS

F. Van de Pol, H. Van Lintel, M. Elwenspoek, J. Fluitman, "A Thermopneumatic Micropump Based on Micro–Engineering Techniques", *Sensors and Actuators*, Proceedings of the 5th International Conference on Solid–State Sensors and Actuators and Eurosensors III, Jun. 25–30, 1989, Montreux, Switzerland, vol. A21, 1990.

C. Cabuz, "Mesoscopic Pumps Based on Bidirectional, Electrostatically Activated, Diaphragm Arrays", Honeywell Technology Center, presented at DARPA Principal Investigations Meeting, Annapolis, Oct. 20–21, 1998.

K. Drost, M. Friedrich, C. Shepard, C. Martin, B. Hanna, D. Hatley, J. Martin, K. Brooks, "Mesoscopic Heat Actuated Heat Pump Project", presented at DARPA Principal Investigators Meeting Annapolis, Oct. 20–21, 1998.

*Primary Examiner*—Henry Bennett
*Assistant Examiner*—Marc Norman
*Attorney, Agent, or Firm*—Greer, Burns & Crain, Ltd.

[57] ABSTRACT

A compact active vapor compression cycle heat transfer device. The device of the invention includes a flexible diaphragm serving as the compressive member in a layered compressor. The compressor is stimulated by capacitive electrical action and drives the relatively small refrigerant charge for the device through a closed loop defined by the compressor, an evaporator and a condenser. The evaporator and condenser include microchannel heat exchange elements to respectively draw heat from an atmosphere on a cool side of the device and expel heat into an atmosphere on a hot side of the device. The overall structure and size of the device is similar to microelectronic packages, and it may be combined to operate with similar devices in useful arrays.

22 Claims, 14 Drawing Sheets

ACTIVE COMPRESSOR VAPOR COMPRESSION CYCLE INTEGRATED HEAT TRANSFER DEVICE

STATEMENT OF GOVERNMENT INTEREST

This invention was made with the assistance of the Defense Advanced Research Project Agency, under contract no. DABT63-97-0069. The Government has certain rights in this invention.

FIELD OF THE INVENTION

The present invention generally concerns active vapor compression cycle vapor compression cycles. Particularly, the present invention concerns compact, low power, active refrigerant heat transfer devices.

BACKGROUND OF THE INVENTION

Cooling is beneficial in countless applications ranging from preservation of perishables to the comfort of humans. It is more difficult to incorporate cooling into small applications, and most practical applications of small scale cooling rely upon application of passive cooling, such as that obtained in microelectronic circuitry through component cooling fins and airflow around the cooling fins. Active cooling is much more efficient at removing heat from a given atmosphere, but well known vapor-compression cycle cooling technology poses serious structural impediments to size reduction that, for the most part, have yet to be overcome.

Many practical applications could benefit from a microcooling approach, i.e. localized cooling as differentiated from macrocooling of a large environment. Examples include clothing cooling systems, packaging for items such as food, blood, organs and medical specimens, and cooling wraps for treatment of injuries. Cooling of electronic circuitry, such as that used in a laptop PC, could increase device operating speed and permit higher component densities. Digital computer package performance is highly dependent on efficient heat dissipation. Automobile, military, manufacturing, and many other applications would also benefit. As examples, chemical warfare protection suits would benefit from improved active cooling, and a suitable active heat transfer device could be used to disguise heat signatures of military equipment, rendering detection of the equipment difficult.

Conventional microcooling devices fail to completely satisfy demands caused by these and other applications. Three common microcooling heat transfer systems are phase change material systems, thermoelectric cooling systems and two part vapor compression systems. Phase change systems use ice, paraffin, or other phase change materials. The materials, or an agent cooled by the materials, is put into thermal contact with the object to be cooled, such as human skin within a clothing garment. These devices are simple, but require inconvenient recharging of the phase change materials, presenting a substantial limitation on their use in most applications. Thermoelectric systems utilize the Peltier effect. Electric current passed through a series of semiconductors causes the semiconductors to get hot on one side and cold on the other. Cooling is through a media or direct thermal contact. The devices have few moving parts, but require a significant amount of power for operation. Conventional vapor compression systems use a portable refrigeration unit having essentially conventional refrigeration equipment and a pump which circulates refrigerant to another part such as a vest or garment. These are highly efficient, but awkward and heavy, relegating their use to a very limited number of applications.

Thus, there is a need for an improved device which addresses some or all of the aforementioned drawbacks. There is a further need for a substantially smaller self-contained vapor compression cycle cooling device. A favorable device could be interconnected with other similar devices to form arrays and could be incorporated in many useful devices.

SUMMARY OF THE INVENTION

These and other needs are met or exceeded by the present vapor compression cycle heat transfer device. High efficiency cooling available in conventional large mechanical compressor vapor compression heat transfer devices is produced by the present invention in a substantially different physical embodiment similar to integrated circuit packagings, and is constructed using traditional and microfabrication techniques. Heating is also available from the device of the invention, since one side of the device will expel heat into an adjacent atmosphere, fluid or object while another side of the device will absorb heat from an adjacent atmosphere, fluid or object. Individual, self-contained devices of the invention draw little electrical power and may preferably be interconnected with like devices to satisfy localized cooling or heating over a desired area of atmosphere, fluid or object.

A device of the invention includes an integrated evaporator, compressor and condenser structure, with the evaporator removing heat from an adjacent atmosphere, fluid or object and the condenser expelling heat into an adjacent atmosphere, fluid or object. The compressor includes cavity defining members and a flexible membrane that compresses refrigerant within the cavity and promotes circulation of the refrigerant through a closed path defined through the compressor, condenser and evaporator.

BRIEF DESCRIPTION OF THE DRAWINGS

Other objects, features and advantages of the will become apparent upon reading the following detailed description, while referring to the attached drawings, in which.

DETAILED DESCRIPTION OF THE INVENTION

The present invention is directed to a compact, integrated and self-contained vapor compression cycle heat transfer device. A compressor in the device is realized through a structure defining a refrigerant cavity and having a flexible diaphragm stimulated by electrical force to compress refrigerant within the cavity. Remaining condenser and evaporator components of the device are formed with microchannels to realize the desired cooling effect on one side of the device and heat dissipation in aid of condensing the refrigerant on the other side of the device. The localized cooling and heating effect of the device may be expanded via interconnection with like devices.

Figure 1:
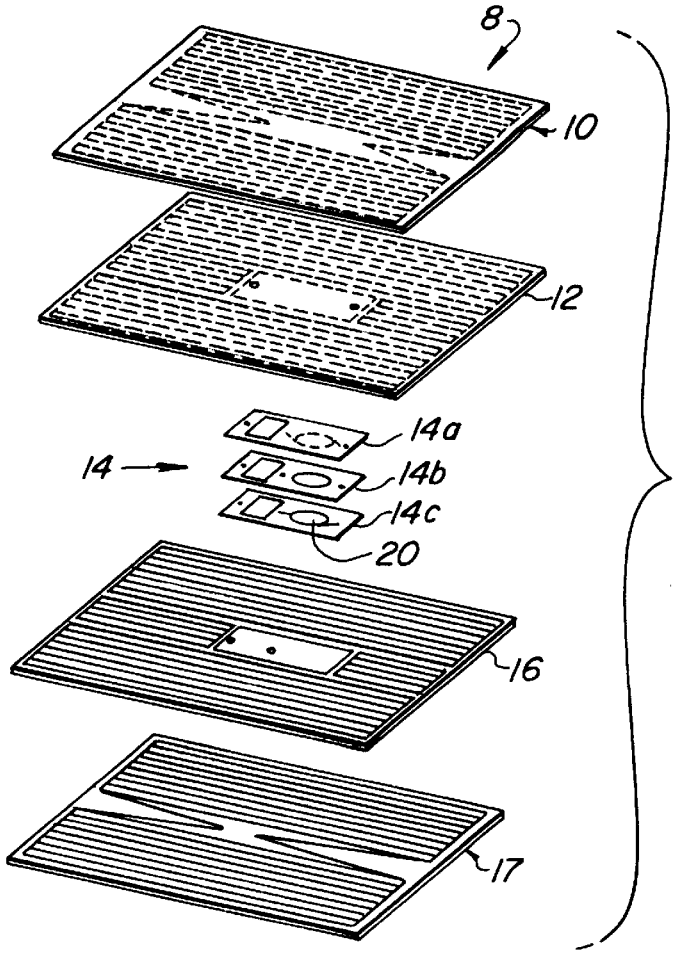
FIG. 1 is an exploded view of a preferred embodiment of the present invention.

Referring now to the drawings, and particularly FIG. 1, shown is a preferred embodiment of a heat transfer device 8 in accordance with the present invention. The device 8 includes a generally layered structure, including a condenser layer 10, a condenser insulator 12, a compressor 14 (including a top compressor wafer 14*a*, a flexible diaphragm 14*b*, and a bottom compressor layer 14*c*), an evaporator insulator 16, and an evaporator 17. Operation of the device is through a general vapor compression cycle with the diaphragm 14*b* being electrically stimulated to compress refrigerant and drive refrigerant through a closed path defined within the device. Refrigerant circulates, heat is dispelled into the atmosphere by the condenser on the top side of the device 8, and is absorbed from the atmosphere by the evaporator 17 on the bottom side of the device 8. The novel structure of the invention provides a compact, integrated, self-contained and generally planar device 8. Exemplary calculated characteristics of the preferred embodiment of the invention are summarized in Table 1 below:

TABLE 1

| Parameter | Units | Approx. Value |
|---|---|---|
| Device 8 Overall | | |
| Overall size (plan) | [mm] | 100 × 100 |
| Total thickness | [mm] | 2.75 |
| Cooling capacity | [W] | 3 W |
| Ideal COP | — | 7.8 |
| Predicted COP range | — | 4–6 |
| Power Consumption | [W] | 0.5–0.75 |
| Refrigerant charge | [g R134a] | 0.9 |
| Refrigerant mass flow rate | [mg/s] | 19 |
| Estimated weight | [g] | 40 |
| Estimated volume Mfg. cost | $ | 5–15 |
| Compressor | | |
| Exterior size (incl. orifice) | [cm × cm] | 2 × 3.4 |
| Total thickness | [mm] | 1 |
| Cavity Diameter | [mm] | 10 |
| Maximum cavity depth | [μm] | 200 |
| Internal volume | [m1] | 0.02 |
| Clearance volume | [μm] | 0.015 |
| Operational frequency range | [kHz] | DC to 10 |
| Volumetric flow | ml/s | 0.7 |
| Pressure ratio | — | 2.4 |
| Design pressure rise | [bar] | 12 |
| Heat exchangers | | |
| Evaporating pressure | [bar] | 5.5 |
| Evaporator channel diam | [mm] | 0.6 |
| Condensing pressure | [bar] | 13.0 |
| Condenser channel diam | [mm] | 0.6 |
| Other | | |
| Connecting line diameters | | |
| liquid & discharge lines | [mm] | 0.2 |
| suction line | [mm] | 0.3 |
| expansion orifice | [mm] | 0.03 |
| Charging pressure | [bar] | 16 |
| Charging temperature | [° C.] | 59 |

Table 1 includes predicted performance specifications for a single device 8 based upon component and system testing conducted to date. The preferred embodiment is designed to produce 3 Watts cooling capacity while operating between 20° C. and 50° C. At those conditions its actual coefficient of performance (COP) will be equal to the product of the ideal COP shown in Table 1 and the isentropic efficiency of the actual compressor, which is not precisely determined but is expected to be approximately 0.7. Thus, final COP of the device is predicted to be in the approximate range of 4 to 6 COP. The robustness of the device 8 will permit operation over a wide range of conditions. As an example, its efficiency should be comparable at both 10° C. and 40° C., while pressure and flow rates would be correspondingly lower at the lower temperature. Power consumption should be in the range of about 0.5 to 0.75 W, while weight of an individual mass produced unit should be about 40 grams.

Obviously, this opens a broad range of applications for the device of the invention due to the small size, efficient cooling, and small power demand of the unit.

The small charge required by an individual device also permits refrigerants which might not otherwise be considered in conventional units from being utilized since there are fewer toxicity and flammability concerns when used in a small individual device. Since the refrigerant charge of each device is individual and self-contained, this concern also does not arise when many individual devices of the invention are operationally combined in an array. R134*a* is a preferred refrigerant pursuant to experiments conducted to date, but others are suitable. Generally, preferred refrigerants will require low pressure lifts in the compressor 14, while exhibiting good thermodynamic properties. Example potential candidates include R13, R13B1, R14, R21, R23, R115, R123*a*, R124, R141*b*, R142*b*, R143, R152*a*, R218, RC270, RC318, R227*ea*, R236*ea*, R245*cb*, R600, pentane [n-pentane], 2-methyl butane [iso-pentane], R744, RE134, RE245, RE245*ca*, R236*fa*, R1270, R116, RE1170. High volumetric flow refrigerants, such as water, are unlikely to work as well and may adversely affect device performance because the compressor 14 of the invention will achieve high pressure lifts.

Figure 2:
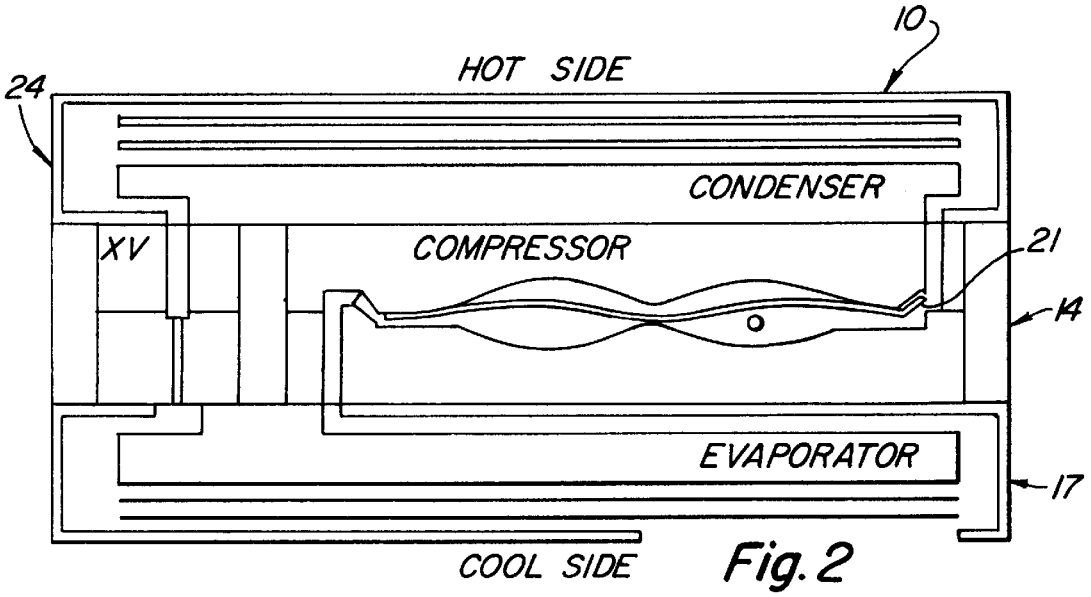
FIG. 2 is an illustration of operation of the preferred embodiment of the invention.

As seen in FIG. 2, an operational cycle of the device 8 starts with the refrigerant vapor being compressed by the compressor 14. The compression causes an increase in temperature of refrigerant fluid within the closed loop in the device 8. A voltage applied between a conductive layer on a surface of a cavity 20 and a conductive layer on the flexible diaphragm 14*b* creates a capacitive force between the conductive planes defined by the cavity and the flexible diaphragm because dielectric, in the form of refrigerant, intervenes between them.

In the illustrated embodiment, both surfaces of the diaphragm 14*b* are conductive, while the outer surface of the cavity (bottom in the figures) 20 in both the wafers 14*a* and 14*c* is conductive. The conductive portion of the diaphragm may also be in its middle with dielectric material on each side, but this increases the distance to the conductive surface of the cavity and reduces the strength of the capacitive action between the elements. Similarly, the conductive portion of the cavity may not be at its surface. With both cavities having conductive portions, the pumping sequence of the diaphragm may therefore be alternated to pump refrigerant in the cavity of the top wafer 14*a* and subsequently in the refrigerant layer in the cavity of the bottom wafer 14*c* separately and sequentially by creating an appropriate electric potential between the respective cavity surfaces and the diaphragm. Pressure on one side of the diaphragm during a pumping cycle on the other side of the diaphragm will assist the work of compression somewhat. While one cavity compresses, the other will preferably draw refrigerant from the evaporator 17. Alternatives include having only a single cavity 20 in one of the wafers 14*a* or 14*c* and/or having only one cavity surface with conductive material.

The action of the compression differs substantially from typical devices in that typical devices use a fixed area compression surface, such as the face of a piston or other displacement member. As the diaphragm 14*b* contracts toward one cavity 20, portions of it will begin contacting the wafer to reduce the surface area of compression during the compression action. This renders the action of compression more efficient than achievable where the area of compression remains constant over the compression stroke.

The cavity 20 preferably has an axisymmetric shape, e.g. donut shape, as best seen in FIG. 2, to avoid bubble mode losses and to aid startup of the diaphragm 14*b* due to close proximity of the conductive portions of the diaphragm 14*b* and the cavity 20 at its center. Flapper valves 22 in the diaphragm 14*b* open and close automatically due to the pumping action of the compressor (only the valves for the half of the cavity are shown in FIG. 2, since the others are perpendicular to the plane of the figure). It is preferred, however, to electrostatically clamp the valves 22 to reduce leakage or back-pressure losses.

High temperature, high pressure refrigerant flows up into the condenser 10 which rejects heat to the environment above the condenser 10 causing the fluid to begin to condense. The fluid then passes through an expansion orifice 24 to cause a sudden drop in temperature. The cycle then completes when the cooled refrigerant absorbs heat from the atmosphere below the device 8 in the evaporator.

Detailed Structure

Artisans will appreciate the significance and novelty of the invention through its preferred structure. With reference to FIG. 1, and additional views of components of FIG. 1, the preferred structure device 8 will now be described. Throughout the discussion of the preferred structure device 8, dimensions of a preferred embodiment will be occasionally described and referenced in the drawings. These dimensions, expressed in millimeters, do not limit the novel structure of the invention to the specific dimensions illustrated, but do serve to emphasize its overall compactness. Alterations from the dimensions shown are therefore considered to be within the scope of the invention so long as the novel overall novel structure of the invention is not departed from.

Figure 3A:
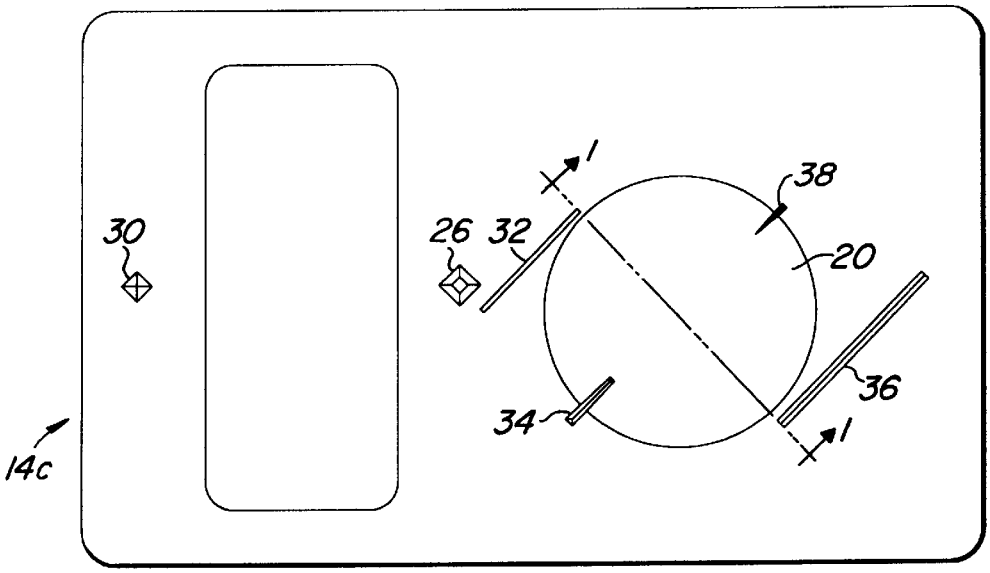
FIG. 3*a* shows a top view of the bottom compressor wafer of FIG. 1.

FIG. 3*a* shows a top view of the bottom compressor wafer 14*c*. This bottom wafer 14*c* defines the cavity 20 which cooperates with the membrane 14*b* to compress refrigerant. Exemplary preferred dimensions of the cavity 20 are an 11 mm diameter and a depth of 0.2 mm. A compressor inlet 26 is in fluid communication with the evaporator 17. A cutout 28 provides thermal isolation between the X-valve 24 formed by orifices 30 in the bottom wafer 14*c* and other layers and the cavity 20 and compressor inlet 26 so that the high heat of refrigerant in the compressor cavity 20 is not conducted to cooled refrigerant being communicated to the evaporator 17 through X-valve orifices 30. The inlet communicates heated refrigerant from the evaporator into a collection channel 32 and then eventually into the cavity 20 via a cavity inlet channel 34. A larger channel 36 serves to communicate refrigerant through layers. A cavity outlet, of smaller dimension than the inlet serves to communicate compressed refrigerant 38 out of the cavity under pumping influence of the diaphragm 14.

Figure 3B:
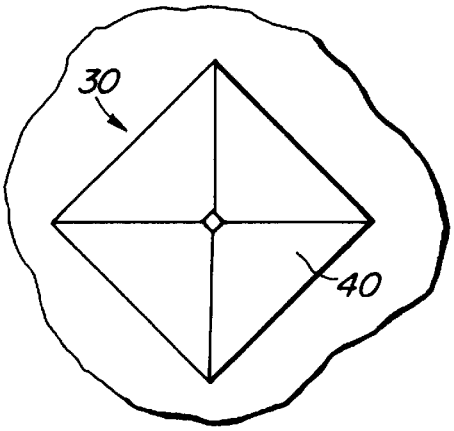
FIG. 3*b* shows a detail view of an X-valve orifice from FIG. 3*a;*
Figure 3C:
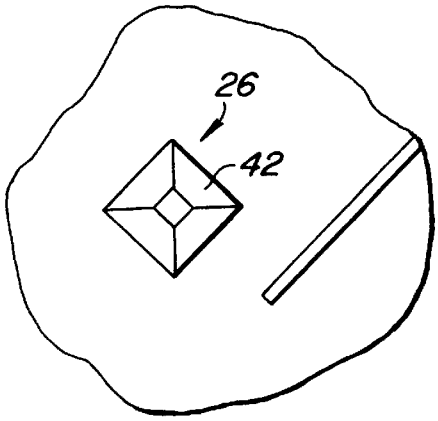
FIG. 3*c* shows a detail view of a compressor inlet orifice from FIG. 3*a;*
Figure 3E:
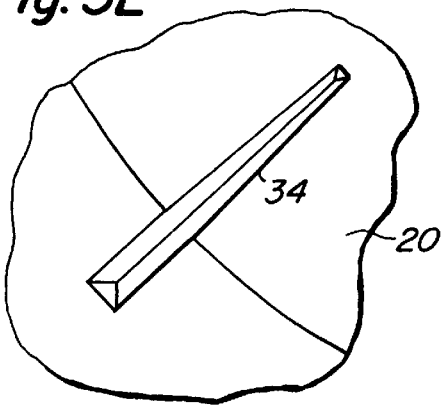
FIG. 3*e* shows a detail view of a cavity inlet from FIG. 3*a;*
Figure 3F:
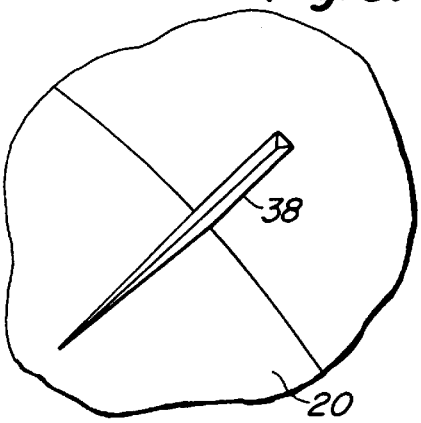
FIG. 3*f* show a detail view of a cavity outlet from FIG. 3*a;*
Figure 3D:
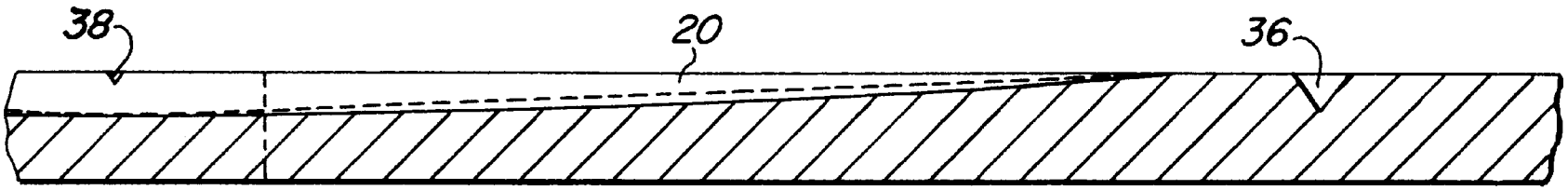
FIG. 3*d* shows a partial cross section taken along section line 1—1 in FIG. 3*a;*
Figure 3G:
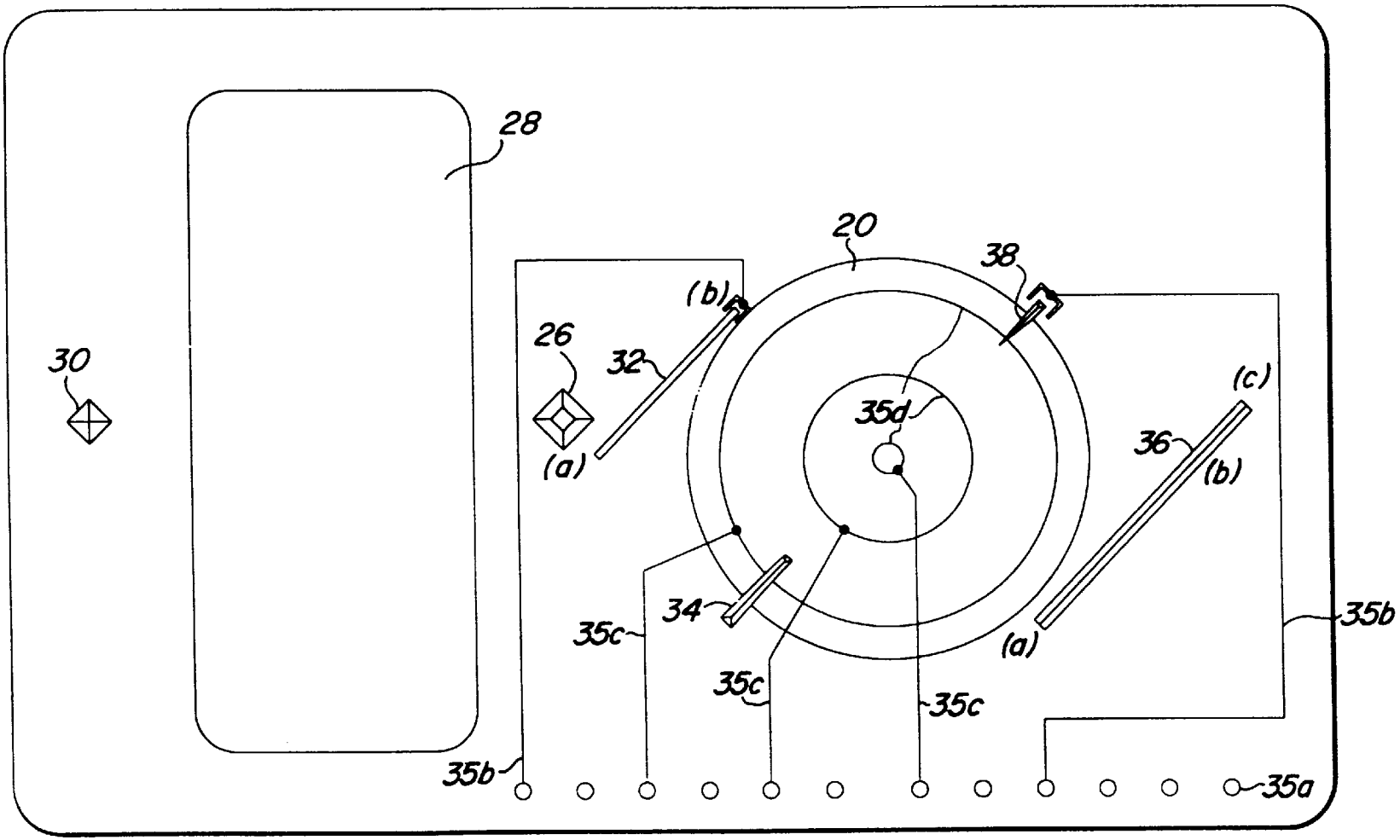
FIG. 3*g* is an additional view of the bottom compressor wafer of FIG. 3*a* showing dimensional relationship of components of the preferred embodiment.

In a preferred embodiment, the X-valve orifice 30 has a 0.76 mm square depressed collection area 40 and a 0.05 mm square opening for collected refrigerant to flow through, as seen in FIG. 3*b*. A preferred compressor inlet has a 1.00 mm square raised collection area 42 and a 0.29 square opening for refrigerant to be passed from the evaporator 17 to the bottom wafer 14*c* of the compressor 14. Angles in the raised surfaces, such as collection areas 40 and 42, and angled surfaces in the channels 32 and 36, as well as other surfaces and channels in the preferred embodiment are etched at 71°. The large channels, such as channel 36 span a 0.27 mm width while small channels such as channel 32 span a 0.09 width. FIG. 3*d* shows a partial cross section taken along line 1—1 in FIG. 3*a*, and illustrates dimensions of a preferred cavity, with the cavity outlet 38 having the small 0.09 mm span and the large channel having the 0.27 span. Details concerning the preferred cavity inlet 34 and outlet 38 are shown in FIGS. 3*e* and 3*f*, respectively. Remaining preferred dimensional relationships are shown in FIG. 3*g*, where length dimensions are illustrated in millimeters.

FIG. 3(*g*) also illustrates electrical components of the bottom compressor wafer. Electrical vias 35*a* provide electrical connections with the evaporator insulator, and leads 35*b* connect vias to valves in the preferred electrostatically clamped valve embodiment. Additional leads 35*c* provide electrical connection to electrodes 35*d* in the cavity 20, preferably formed as multiple separate electrodes to encourage a zip action in the compressor as it compresses. Solder bumps 69*c* in one layer oppose vias 35*a* in another layer to provide electrical connections between layers in a manner commonly used to connect printed circuit board (PCB) layers.

Figure 4A:
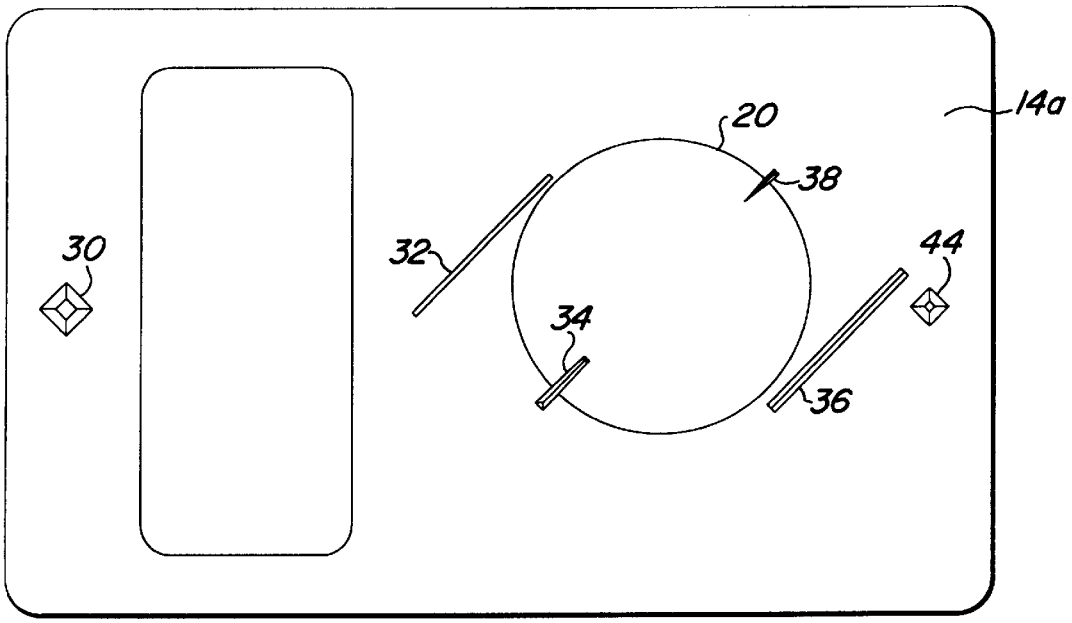
FIG. 4*a* is a bottom view of a top compressor wafer of FIG. 1.
Figure 4B:
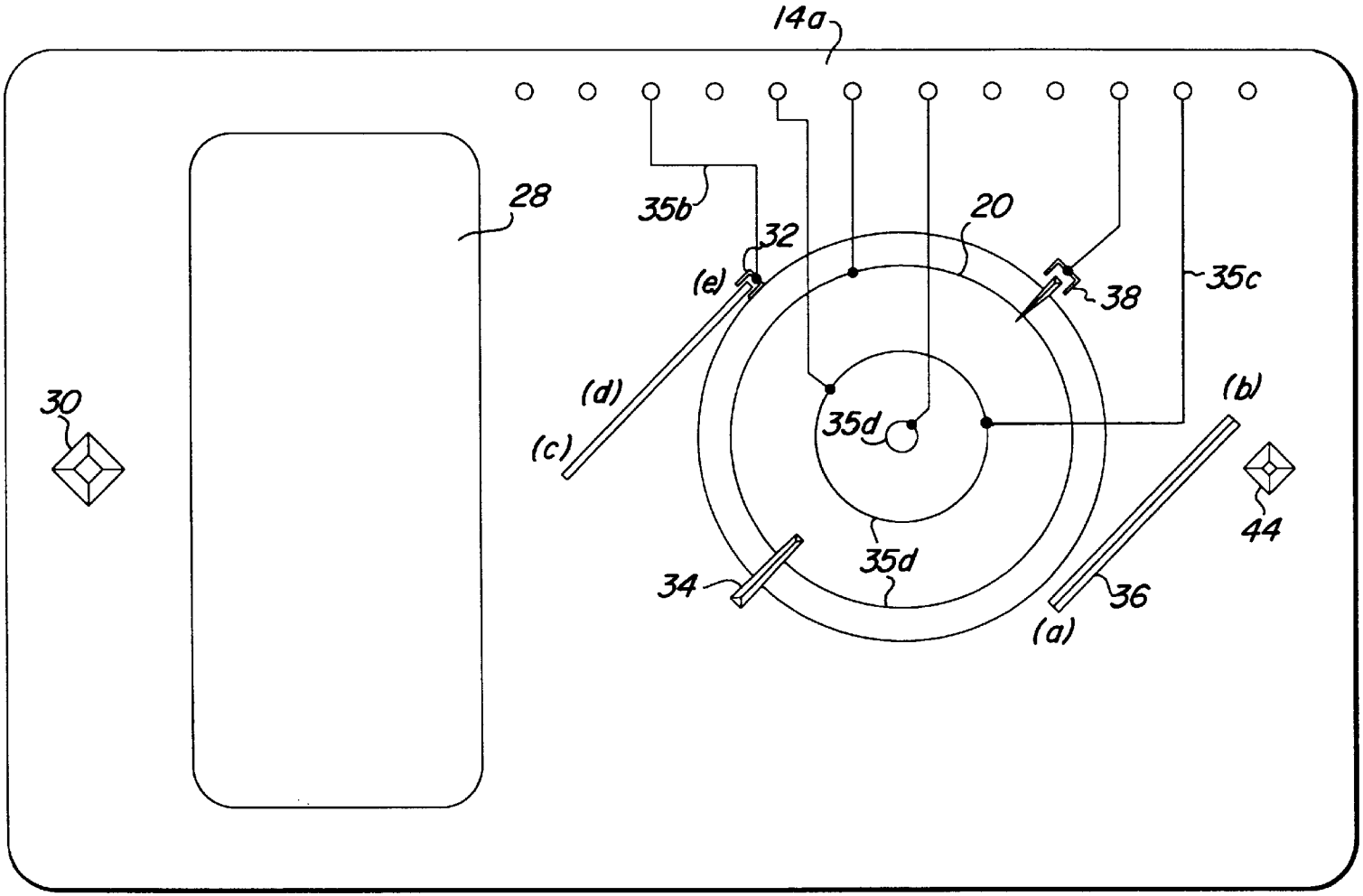
FIG. 4*b* is a detail view of an X-valve inlet shown in FIG. 4*a;*

FIG. 4*a* is a bottom view of the top compressor wafer 14*a* of FIG. 1. It is largely similar to the bottom compressor wafer, including similar dimensions for corresponding elements, with the exception of a larger X-valve inlet 30 (1.21 mm square depression and 0.5 mm opening). The top compressor wafer 14*a* includes a channel 32, cavity 20, cavity entrance channel 34, cavity exit channel 38, and large channel 36. A compressor outlet 44 presents a depression on the bottom side of the wafer 14*a* to collect refrigerant being expelled from the compressor 14 to the condenser 10. The preferred dimensions for the compressor outlet 44 are the same as the compressor inlet 26. Remaining dimensional relationships for the top compressor wafer 14*a* are shown in FIG. 4*b*, where like electrical components are identified using the numbering adopted in FIG. 3*g*.

Figure 5A:
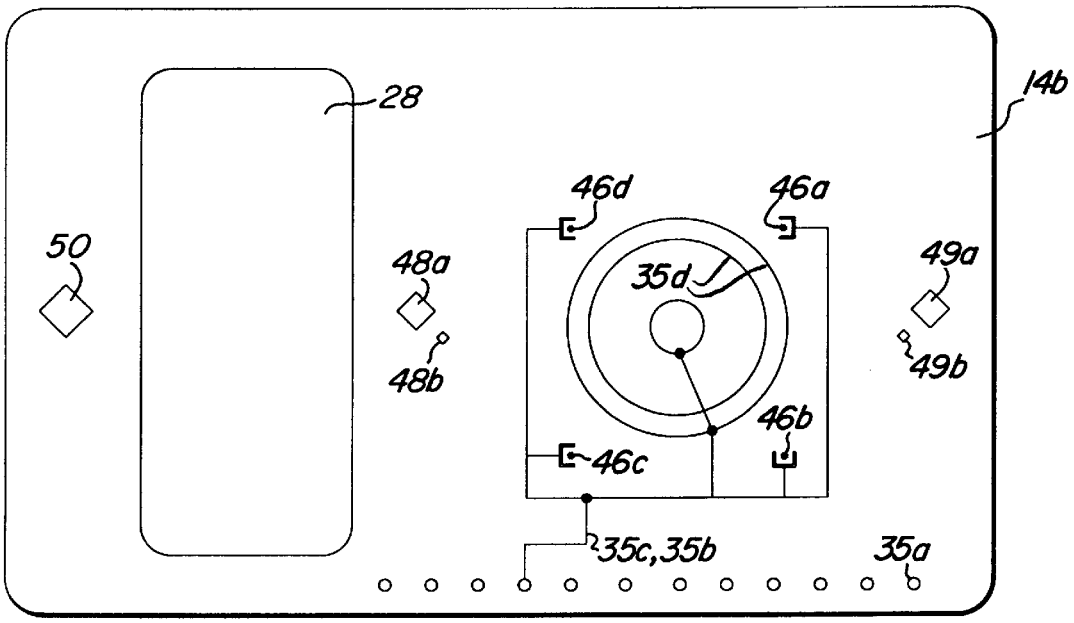
FIG. 5*a* shows a top view of the flexible diaphragm shown in FIG. 1.
Figure 5B:
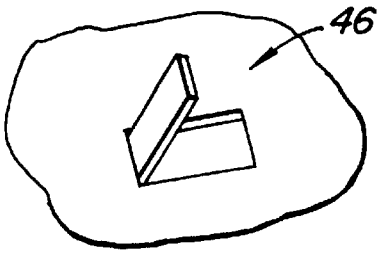
FIG. 5*b* shows a detail of an open flapper valve from the diaphragm of FIG. 5*a;*
Figure 5C:
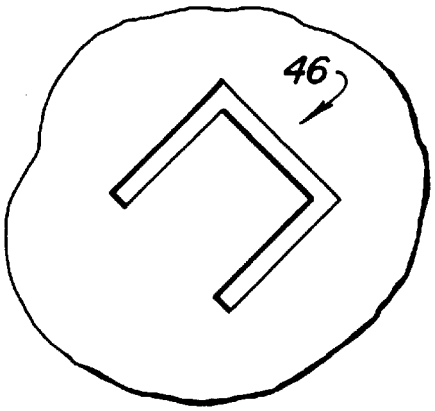
FIG. 5*c* shows a detail of a closed flapper valve from the diaphragm of FIG. 5*b;*
Figure 5D:
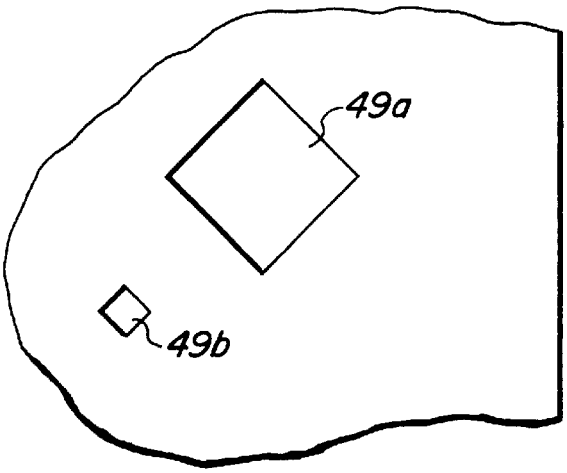
FIG. 5*d* shows a detail of outlet cut-outs from the diaphragm of FIG. 5*a;*
Figure 5F:
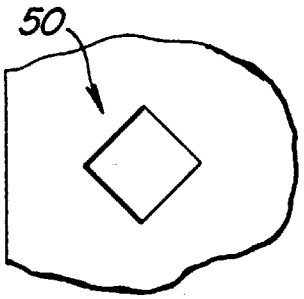
FIG. 5*f* shows a detail of an X-valve cut-out from the diaphragm of FIG. 5*a;*
Figure 5E:
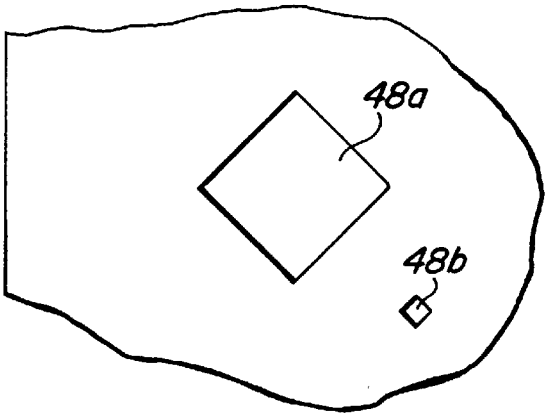
FIG. 5*e* shows a detail of inlet cut-outs from the diaphragm of FIG. 5*a;*

FIG. 5*a* shows a top view of the flexible diaphragm 14*b*. The preferred diaphragm is 0.004 mm thick, and corresponds in size generally to the wafers 14*a* and 14*c*. An electric potential is created by applying a voltage differential between the metallized layer (or separate sequential electrodes) of the diaphragm 14*b* and a metallized layer on the bottom wafer 14*c* causes contraction of the diaphragm to compress refrigerant in the cavity 20 and assist movement of the refrigerant into the condenser 10. The cyclical pumping of the flexible diaphragm by varying electrical potential between the diaphragm and the bottom wafer also serves to open and close flapper valves 46*a–d*, which control refrigerant flow into and out of the cavity 20. FIG. 5*b* shows a detailed view of an open flapper valve 46, and FIG. 5*c* shows preferred dimensions of a flapper valve 46 formed in the membrane 14*b* via etching. Pairs of cut-outs 48*a*, 48*b* and 49*a*, 49*b* permit fluid flow between wafers 14*a* and 14*c* via the compressor inlet 26 and the compressor outlet 44. FIG. 5*d* shows a detailed view of the pair of outlet fluid flow cutouts 49*a*, 49*b* and FIG. 5*e* shows a detailed view of the pair of inlet fluid flow cut-outs. An X-valve cutout 50 permits unrestricted refrigerant flow from the compressor to the evaporator via the X-valve 24. FIG. 5*f* shows a detailed view with dimensions of the X-valve cut-out.

Figure 6A:
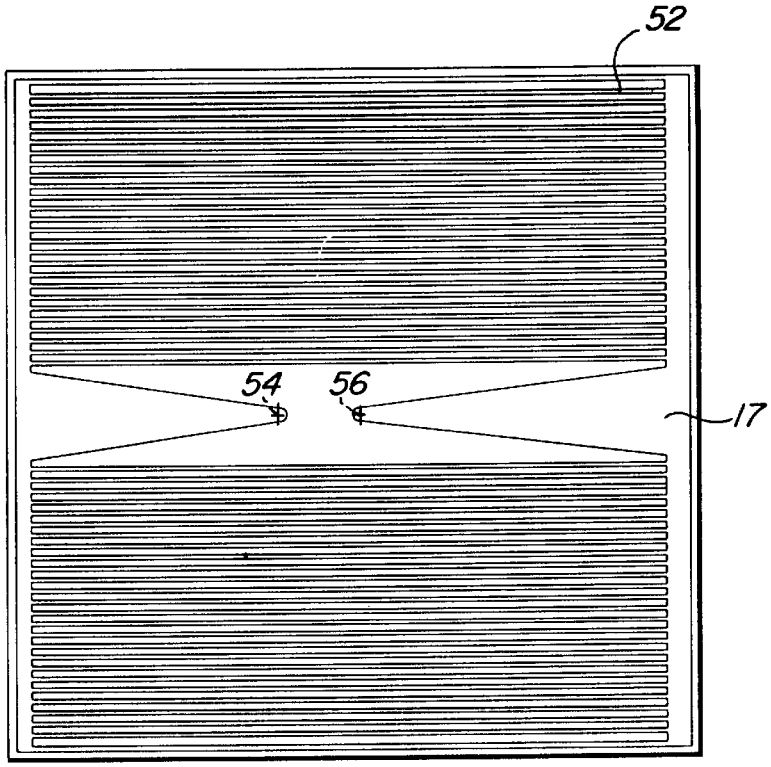
FIG. 6*a* is a top view of the evaporator in FIG. 1.
Figure 6B:
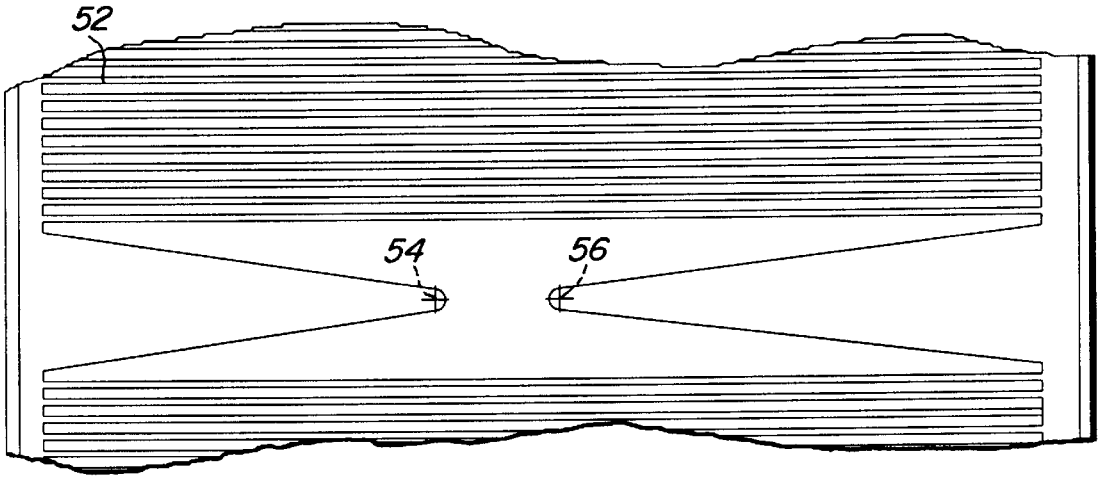
FIG. 6*b* is a detail view of a portion of the evaporator shown in FIG. 6*a;*
Figure 6D:
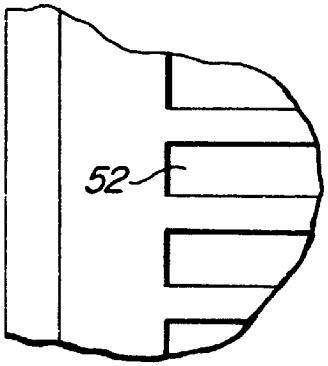
FIG. 6*d* is a detailed view of a portion of the evaporator shown in FIG. 6*a;*
Figure 6E:
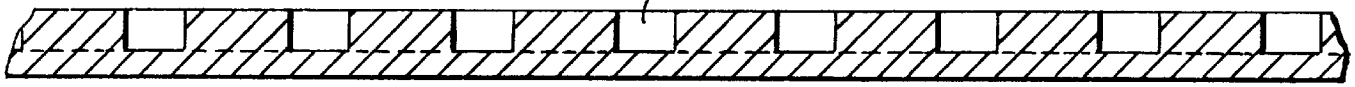
FIG. 6*e* is a partial cross section taken along section line 2—2 in FIG. 6*c;*
Figure 6C:
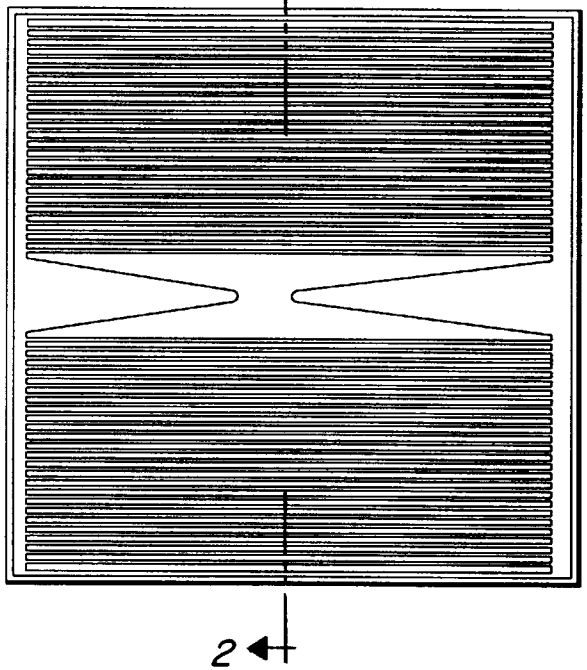
FIG. 6*c* is a section cut view of the evaporator shown in FIG. 6*a;*

FIG. 6*a* shows a top view of the evaporator 17 of FIG. 1. The evaporator 17 is a heat exchanger formed from a plurality of microchannels 52. As seen in a detailed view in FIG. 6*b*, the pattern of refrigerant flow microchannels 52 is fed by an evaporator inlet 54 (having a 0.75 mm radius) which aligns with the X-valve outlet 30 formed in the bottom compressor wafer 14*a*. After traveling in the part of the closed loop formed by the microchannels 52 and accepting heat from the atmosphere below the evaporator 17, the refrigerant exits the evaporator via an evaporator outlet 56 (having a 1.00 mm radius). FIGS. 6*c*, 6*d* and 6*e* illustrate details of the evaporator channels including preferred dimensions and shapes for the channels. The cross section view of FIG. 6*e* is taken along line 2—2 in FIG. 6*c*.

Figure 7A:
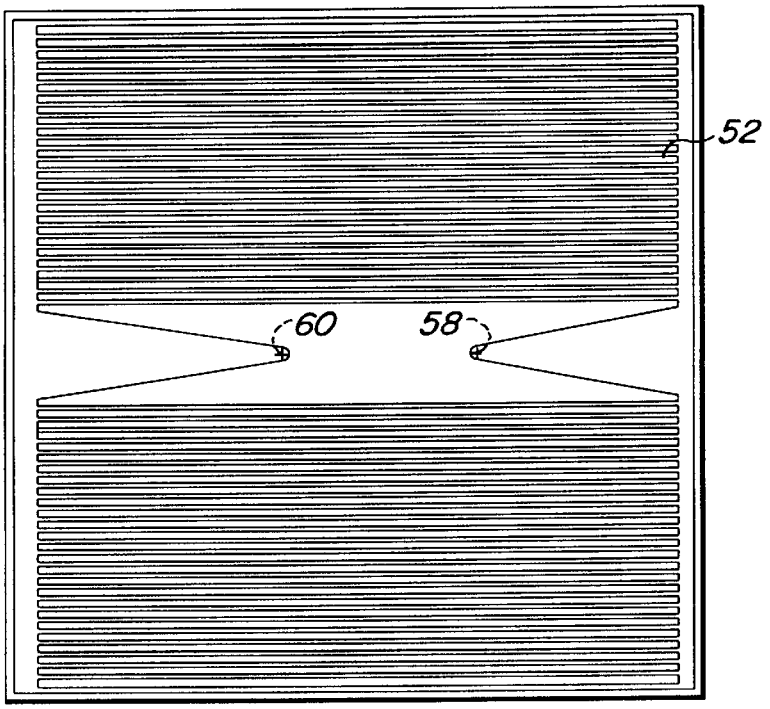
FIG. 7*a* is a top view of the condenser from FIG. 1.
Figure 7B:
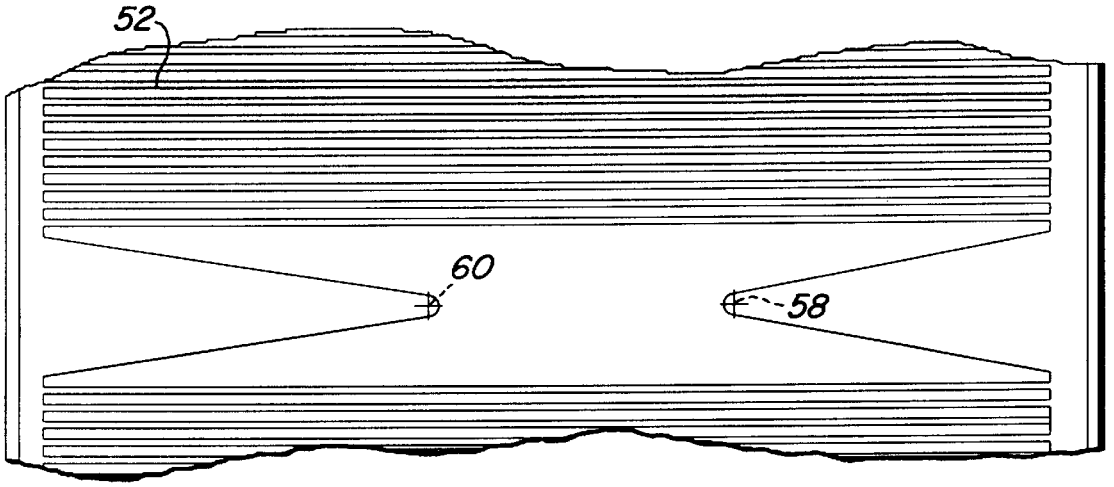
FIG. 7*b* is a detail view of a portion of the condenser shown in FIG. 7*a;*

The condenser 10 is highly similar to the evaporator 17, as seen in the top view of the condenser 10 in FIG. 7*a*. The condenser includes channels 52 of similar dimension and layout to those in the evaporator 17. Shown in FIG. 7*b*, a condenser inlet 58 (having a 1.00 mm radius) aligns with the compressor outlet 44 defined in the top compressor wafer 14*a* to accept heated and compressed refrigerant from the compressor 14. A condenser outlet 60 (having a 0.75 mm radius) accepts condensed, cooled refrigerant cooled and condensed by heat exchange from the condenser to the atmosphere above the condenser 10.

Figure 8A:
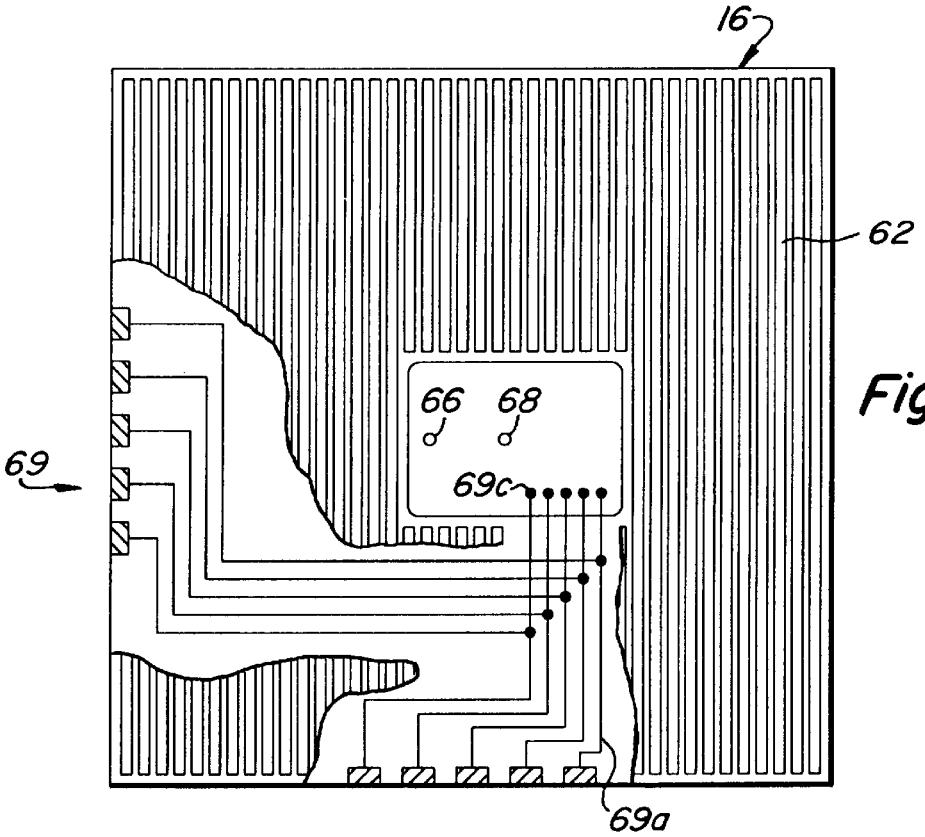
FIG. 8*a* is a top view of the evaporator insulator from FIG. 1.
Figure 8B:
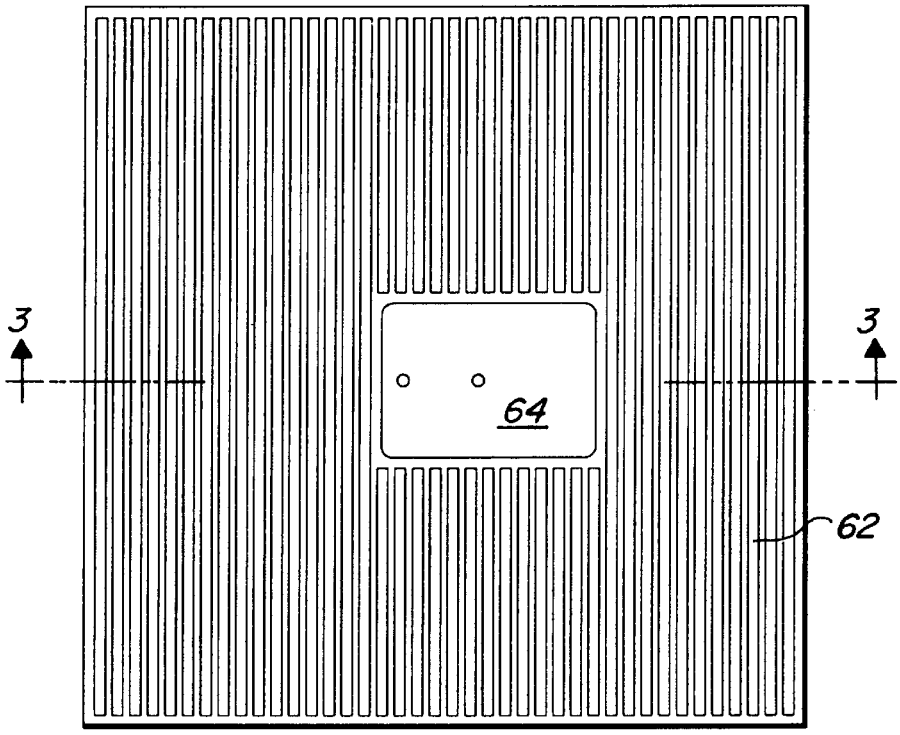
FIG. 8*b* is a section cut view of the evaporator insulator from FIG. 8*a;*
Figure 8E:
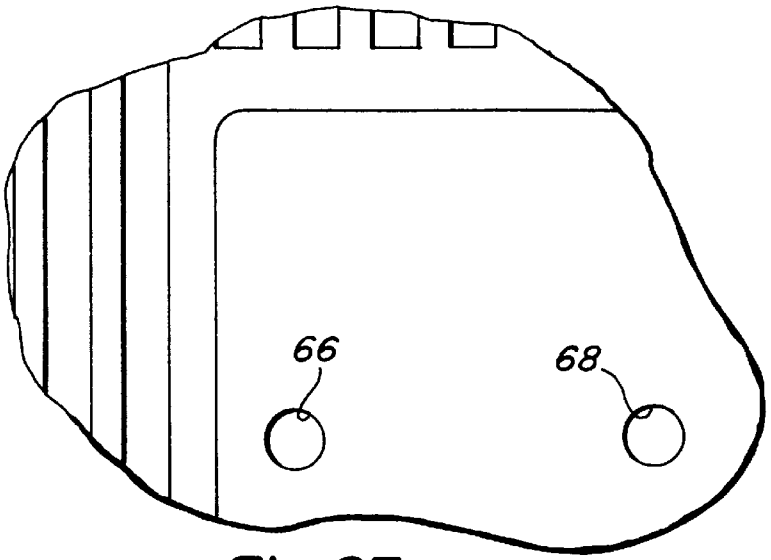
FIG. 8*e* is a detailed view of through holes from FIGS. 8*a* and 8*d;*
Figure 8D:
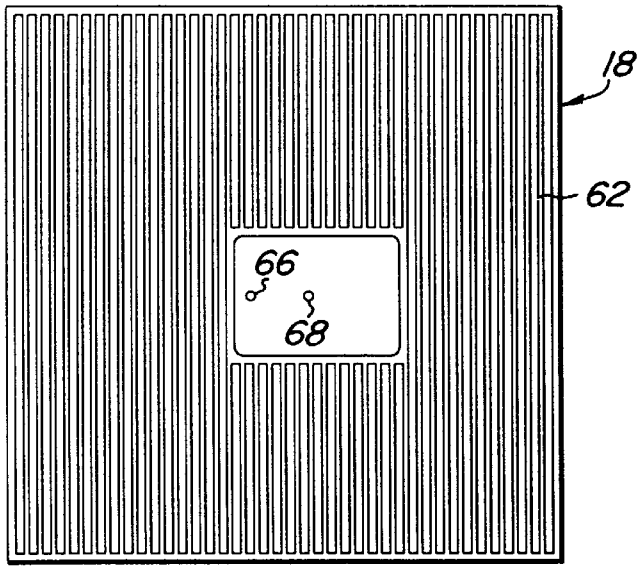
FIG. 8*d* is an additional top view of the evaporator insulator from FIG. 1.
Figure 8C:
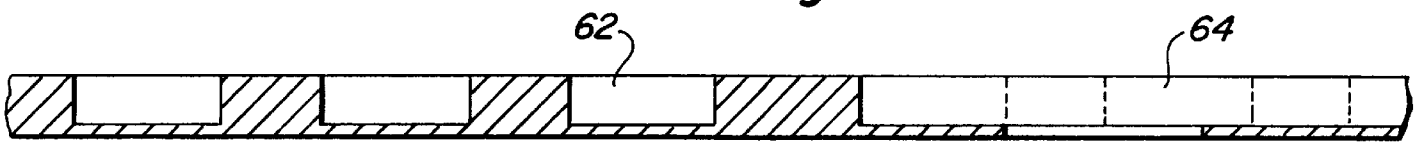
FIG. 8*c* is a partial cross section taken along section line 3—3 in FIG. 8*b;*

Efficient operation of the device 8 requires thermal isolation between hot and cool areas of the device. As described above, isolation is provided between the compressor cavity 20 and the X valve 24. Isolation between the evaporator 17 and the compressor 14 is provided by the evaporator insulator 16. As seen in the top view of FIG. 8*a*, the evaporator insulator 16 includes a plurality of channels 62, details of which are shown in FIGS. 8*b* and 8*c*. The cross section of FIG. 8*c* is taken along line 3—3 of FIG. 8*b*. The channels 62 run perpendicular to the channels 52 of the evaporator and act as a thermal barrier. The evaporator insulator 16 also includes a compressor cut-out 64 to accommodate the compressor 14. The cut-out 64 is provided with thru-holes 66 and 68, as seen in FIGS. 8*d* and 8*e*, which respectively align with the evaporator inlet 54 and both the compressor inlet 26 and the evaporator outlet 56.

Figure 9A:
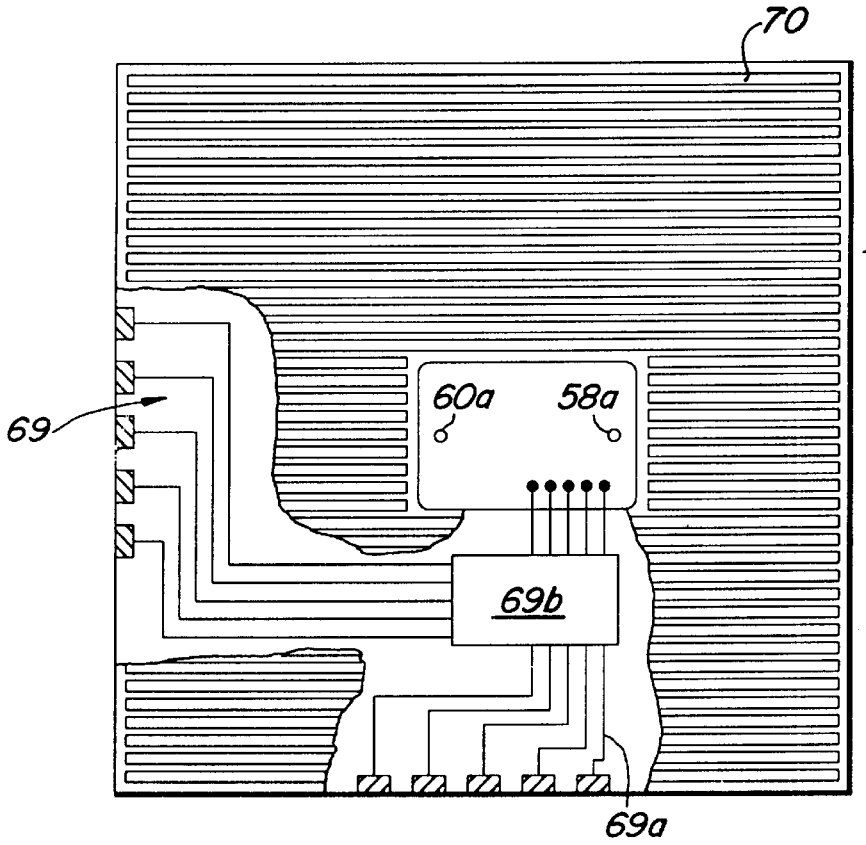
FIG. 9*a* is a top view of the condenser insulator from FIG. 1.

The evaporator insulator 16 also serves as electrical connection to outside power sources through electrical connection network 69. The connection part of the network 69*a* preferably connects on all four sides of the device 8, though only two sides are illustrated as having terminals. Outside control circuitry may be used to control compressor actions, or an on board chip 69*b* may be included, as illustrated in FIG. 9*a*. Solder bumps 69*c* provide connection to the compressor wafers.

Figure 9B:
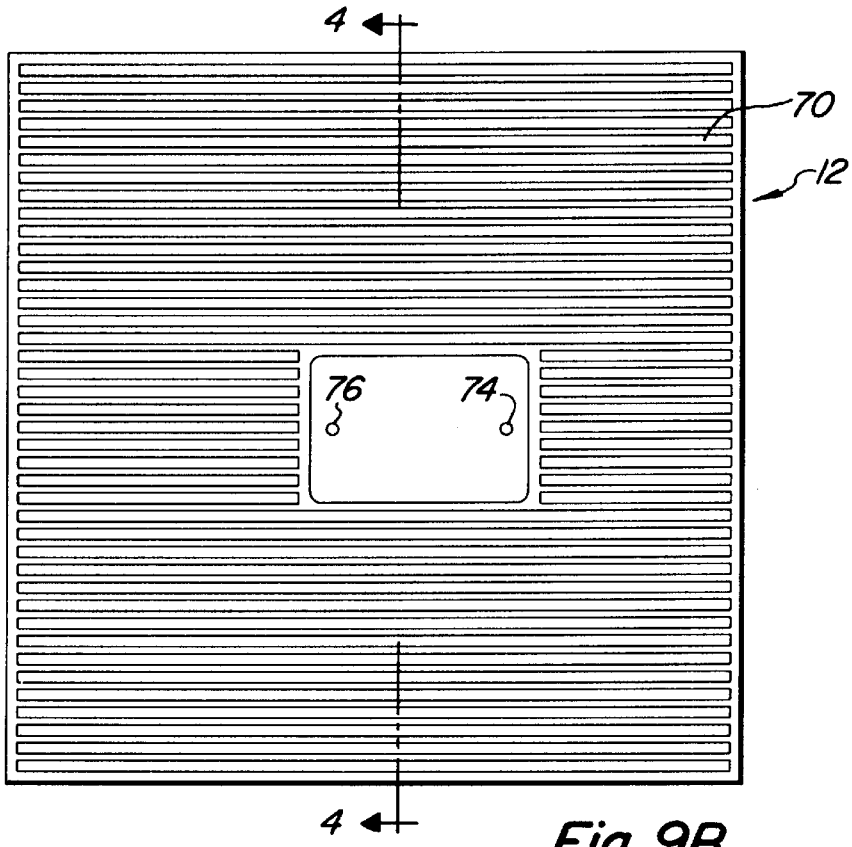
FIG. 9*b* is a section line view of the condenser insulator of FIG. 9*a;*
Figure 9C:
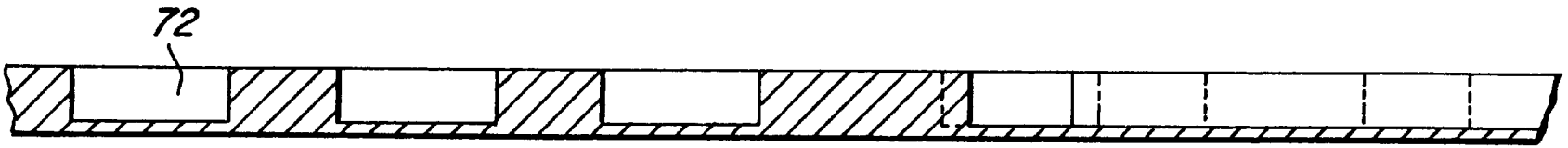
FIG. 9*c* is a partial cross section taken along section line 4—4 in FIG. 9*b*.
Figure 9D:
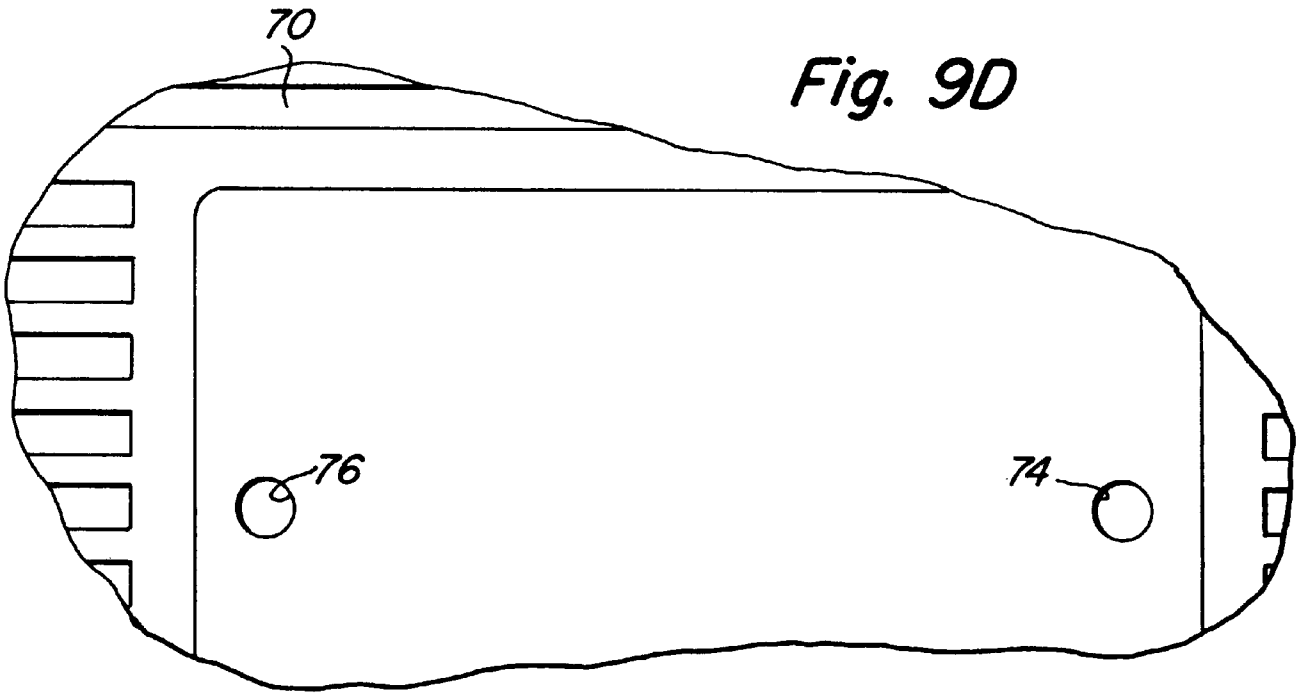
FIG. 9*d* is a detailed view of through holes in the condenser insulator of FIG. 9*a*.

The condenser insulator 12 is highly similar to the evaporator insulator 16 in structure and dimensions, with an exception being that the evaporator insulator channels 70 run perpendicular to the channels 62 in the evaporator insulator 12, i.e. parallel to the channels 52 in the condenser 12 and the evaporator 17, as seen in FIGS. 9*a–c*. FIG. 9*c* is a cross section taken along line 4—4 in FIG. 9*b*. The condenser includes separate through holes 74, 76, also seen in the detailed view in FIG. 9*d*. The hole 74 aligns with the compressor outlet 44 and the condenser inlet 58 to permit unrestricted flow therebetween. Similarly the hole 76 aligns with the condenser outlet 60 and the X-valve inlet 30 to allow unrestricted flow therebetween, completing the closed flow path coming the evaporator 17, compressor 14 and the condenser 10.

Compressor Refrigerant Flow in Dual Cavity Embodiment

Having illustrated the structure of the preferred embodiment and the basic refrigerant flow between the separate components of the device 8, the complete flow of refrigerant through the compressor layers may now be understood. The discussion here is for the most complex arrangement, namely the preferred embodiment where fluid flow is on both sides of the diaphragm 14*b* and pumping is conducted in cavities 20 in both layers 14*a* and 14*c*. Artisans will appreciate that components of the compressor used to transport refrigerant between layers may easily be omitted and others modified if refrigerant is kept on one side of diaphragm 14*b* and/or compression is only on one side of diaphragm.

Fluid exits the bottom compressor cavity through outlet channel 38 (FIG. 3*g*). It then passes through open flapper valve 46*a* (FIG. 5*a*) and into end (a) of channel 36 of the top SI wafer 14*a*, then along channel 36 to other end (b) of channel 36. It exits back to the bottom compressor wafer 14*c* via port 49*b* in diaphragm and into channel 36 (FIG. 3*g*) of the bottom wafer at intersection point (b) to meet upper cavity fluid stream. Combined streams from upper and lower compressor cavities flow along channel 36 in bottom wafer 14*c* to end (c) of the channel 36 of the bottom wafer 14*c* and enters diaphragm 14*b* again at orifice 49*a* to pass through to top wafer 14*a* via orifice 44 (FIG. 4*b*) and through inlet orifice 58*a* in condenser insulator 12 (FIG. 9*a*).

Refrigerant then flows into the condenser inlet 58, and through the microchannels 70, back through X-valve 24 and into the evaporator 17, through microchannels 62, as previously described, until again reaching the compressor through the evaporator outlet 56. Refrigerant enters the compressor through the compressor inlet 26 (FIG. 3*g*), through the diaphragm 14*b* at 48*a*, and into the channel 32 of the top wafer 14*a* at end (c) (FIG. 3*g*). The fluid flows through the channel 32 to point (d) where it splits. Some will flow to the compressor cavity 20 in the top wafer 14*a* while some will continue on to end (e) of the channel 32 where it will pass through the diaphragm valve 46*c* (FIG. 5*a*) and into the compressor cavity inlet 34 for the cavity in the bottom compressor wafer 14*c* (FIG. 4*b*).

Fluid exits the top compressor cavity through cavity outlet 38 (FIG. 4*b*) of the top compressor wafer 14*a*, and passes through open flapper valve 46*b* (FIG. 5*a*) and into end (a) of large channel 36 of the bottom wafer 14*c*. It then flows along channel 36 to point (b) where it combines with flow from the bottom compressor cavity at intersection provided by orifice 49*b* in the diaphragm 14*b* and flows on to exit through diaphragm 14*b* at orifice 44 (FIG. 4*b*) and through 58 in the condenser insulator. From port 48*b* of the diaphragm, fluid passes into channel 32 of the bottom compressor cavity and through channel 32 to exit at end (b) and pass through diaphragm valve 46*d*.

Fabrication and Materials

The device 8 of the invention is fabricated according to a combination of macro and microfabrication techniques. Low end dimensions in the device of the invention are realizable through microfabrication techniques, while higher dimension features may be achieved via low pressure injection molding techniques.

Heat Exchanger Fabrication

Two heat exchangers are required (condenser and evaporator). The major fabrication steps to create either are nearly identical, thus, only the one fabrication sequence will be discussed. Two construction approaches, however, have been demonstrated (microfabrication, injection molding). The application (cross sectional area, refrigerant choice, operation pressure) may drive the final choice of fabrication methods. The preferred method of fabricating the invention employs a layered approach, or an approach similar to laminate manufacturing, in order to provide a robust method for high volume production. Individual components of the device 8 are partially or wholly fabricated in layers, and then are assembled and bonded together. Components are aligned to communicate electrically and to communicate refrigerant fluid with other components. The fabrication of each component is discussed to explain a means to manufacture and its relationship to the other components to be assembled together. The separate components are the condenser 10 and evaporator heat exchangers; the electrical connection and thermal insulating layers, i.e. evaporator insulator 12 and condenser insulator 16 between the heat exchangers; and the compressor 14 assembly including: cavities, channels, diaphragm, valves, and expansion orifice between the heat exchangers.

Microfabricated Heat Exchanger

The heat exchangers in total are comprised of the condenser 10 and evaporator 17 components that contain the heat transfer channels in which the refrigerant flow plus a base to seal the cavities. The base sealing surface in this embodiment are supplied by top of the electrical connection and thermal insulator layers 12 and 16. The fabrication of both the evaporator and condenser are similar. A preferred method to fabricate the condenser and evaporator shells for mass manufacture is by injection molding. Injection molding of small channels has been demonstrated, and is a suitable and well-known technology for artisans. Molds containing the channels in the exchangers are made and the desired polymer are injected into the mold, thereby taking on the desired shape. Thermosetting polymers can be produced using compression molding, low pressure injection molding, or reaction injection molding. Several polymer materials are also suitable for use with injection molding, and are compatible with refrigerants that can be employed in the invention. One material that can be used is a thermosetting polyester. Thermoset polyesters, in addition to having sufficient strength, compatibility with many standard refrigerants, and the ability to be injection molded, can be thermally bonded together, which aids assembly of the device, and the composition can be altered by use of filler materials to provide good thermal conductivity.

For use of the invention over long time periods, refrigerants under pressure may eventually be lost to the surroundings due to the permeability of the material and the subsequent diffusion of the high pressure gases through the polymer walls. The rate of loss varies greatly between different polymers and refrigerants. Small molecule refrigerants tend to diffuse more rapidly through solid polymers than those comprised of larger molecules. Different polymers are also more or less permeable to molecules of various chemistries. Long term loss is exacerbated since the invention employs relatively large surface areas, compared to the total amount of refrigerant charge used. A diffusion or vapor barrier comprised of a thin film of metal may be added between the layers and/or on top surfaces of the heat exchangers to reduce the potential for diffusion. If the metal vapor layer is on the surface, a thin polymer coating can be placed over it to protect it from wear.

Thermal Insulating Layers Including Electrical Leads

The base for the condenser 10 and evaporator 17 can be supplied by the condenser insulator 12 and evaporator insulator 16, using commercially available (e.g. ELMEC Manufacturing) Kapton-based flexible sheets, or injection molded thermal isolation layers. The opposite side of the exchanger base is used to bring electrical connections to the compressor, similar to standard metallized flexible circuit boards. Therefore, the condenser insulator 12 and evaporator insulator 16 serve dual purposes. If a thermal isolation layer is not employed, these layers are fabricated identically as flexible printed circuit boards. To provide communication of the fluid channels in the heat exchangers with those in the compressor assembly, vias or ports are machined and aligned with those in the assembly. In addition, a recess can be machined or patterned to hold respective components in the correct alignment with the ports for easier final assembly.

Bonding between condenser 10 and condenser insulator 12 and between evaporator insulator 16 and evaporator 17 can be provided by choosing an appropriate adhesion process dependent upon the materials used for the components. If Kapton-based sheets are used for the condenser insulator 12 and the evaporator insulator 16, a heat-sealable polyimide from Dupont can be applied between the thermoset polyester and the Kapton. If both are thermoset polyesters, then they can be directly heat sealed to each other by applying the appropriate heat and pressure, as directed by the supplier of the material used for the components.

Injection molding of polymers may be used in mass manufacture. To achieve good thermal isolation, the opposite side of the evaporator or condenser base is patterned with recesses to provide gaps between the evaporator and its insulator and the condenser and its insulator to thermally insulate them. Tips of the recesses between both insulating layers combine when brought together to minimize contact area (and thus heat transfer between the hot and cold side). The patterned area may then be metallized with a thin layer of evaporated metal, such as aluminum, to act as a shield against radiant heat transfer, and to act as a vapor barrier against diffusion of refrigerant into the recesses. Thermosetting polyesters can be molded to the desired configurations. Moreover, the compositions can be altered to have lower thermal conductivity in the condenser polyester than in the evaporator polyester.

After molding, metal leads can be evaporated and patterned using standard techniques into vias provided in the molds to link the edges where power is supplied to the compressor. These metal leads are to be separated from any vapor barrier metalization.

Compressor

The preferred embodiment of the compressor assembly 14 includes three components: two silicon wafers that contain the compressor cavities and the expansion orifice, and a flexible diaphragm that contain the displacement membrane and valves. The compressor utilizes an shaped indention, or cavity 20, in a silicon wafer. The type of silicon wafer is that which is predominately used in the microelectronics industry. Other materials are also obviously suitable, and may be used if they achieve the same shape and have similar permeability characteristics. Since different embodiments may require differing shapes, a method is used that can create a specific cavity profile that can be related to mathematical functions in projection as well as depth. The usual methods employed in microelectronics to etch silicon are not able to make arbitrary profiles in depth. Therefore, a method used to fabricate the cavity for this invention preferably employs ultrasonic machining (USM). USM is used extensively in other industries to machine brittle materials such as glass and ceramics, as well as silicon. To fabricate the cavity with a preferred toroidal-like shape having a raised center portion as depicted in FIG. 2, a steel tool was tumed using a computer controlled lathe to the desired function, $$y(r)/\text{ymax}=0.1+14.64\ (r/a)^2-29.77\ (r/a)^3+15.14\ (r/a)^4-0.1\ (r/a)^5$$

where ymax is the deepest part ofthe cavity which for one embodiment is 100 microns, r is the radius outward from the center, and a=5 mm is the outermost radius of the cavity. The USM steel tool was used with 400 grit silicon carbide abrasive slurry to form the cavity in silicon. The resulting profile closely matched the desired shape, with a surface roughness of several microns. To smooth the USM surface further, several processes are possible, including the use of a well-known isotropic etch of 70% concentrate nitric acid and 30% concentrated hydrofluoric acid for a few minutes. However, oxidation of the wafer at 1050 C in oxygen for 4 hrs, followed by a 30% hydrofluoric acid dip, and repeating twice more can also be utilized. Although not as much material is removed as acid etching, oxidation smoothing maintains the profile obtained with USM without undue need to optimize the process.

The features in the silicon compressor wafers, e.g. inlet channels, outlet channels, etc. are formed by selective removal of silicon in precisely defined locations. Selective silicon etching can be accomplished using an anisotropic etchant (e.g. aqueous potassium hydroxide). A material that resists the etchant, silicon nitride, is first deposited on the silicon surface using standard low pressure chemical vapor deposition techniques. The nitride is then patterned using standard photolithography to expose the silicon in areas where channels, vias, orifices, or isolation is required. To form channels, the silicon is etched only part way through the wafer, while an orifice or isolation break in the silicon is etched completely through the wafer. For example, to form the orifice, etching through the entire wafer are carried out on two silicon wafers. The resultant dimensions of the orifice are carefully controlled to design specifications (e.g. 10 micron by 10 micron). On a second wafer a larger via or port is etched. During the construction of the compressor the two wafers are aligned (such that the orifice and via are lined up) and bonded together. The aligned orifice and via provide a fluid path between the two heat exchangers with the orifice serving as an expansion nozzle in the refrigeration cycle. Larger through wafer etches and aligned bonding can be used to thermally isolate the expansion orifice from the compressor. Similarly, channels can be etched on each wafer to provide fluid paths between the compressor, input/output valves and the heat exchangers. The tops of the channels are provided by the second wafer during the compressor bonding process. These fluid transport components (channels, orifices, ports/vias) combine to create a continuous fluid path through the device.

The valves at the inlet and outlet of the compressor can be made from a combination of selective etching of the silicon wafer, as described above, and selective bonding of a polymer flap. A polymer flap can be made by using a larger patch and cutting a relief around three sides, providing a hinge with the remaining side. By bonding the patch at all places, save the flap, with the flap placed over an opening that is sufficiently smaller than the flap so that it completely covers the opening when it is laying flat, a one way valve can be constructed. A second wafer with an orifice or channel that is larger than the flap so that it can open without interference, can be aligned and bonded on top of the first, save for the area over the flap. When the pressure below the flap is higher than above it, the flap opens, and vice versa. The channels and orifices can be fabricated as discussed above with anisotropic etchant. If the diaphragm material is used for the polymer flap, electrical connections within the polymer flap can be exploited to provide capacitive action to hold the flap against pressure from below the flap, if desired. To utilize the capacitive action for the flapper valves, the area around the smaller orifice on which the flap rests when closed must be made conductive, with a dielectric above the conductive plane being desirable. Similarly, the flap should be patterned with a conductive plane, as discussed below, to mate with the valve seat conductive plane. Leads providing electrical connections for the valve flap and seat are made in the same way as for the conductive planes.

The conductive planes are used to provide a means for electrostatic attraction in the compressor cavity and to provide extra holding power for the valves. The conductive planes can be fabricated in several ways that are well-known in the microelectronics industry. Two methods which can be used involve metalization and ion implantation. For metalization methods, a metal such as chrome is deposited and patterned on the wafer where desired. Dielectric layer(s) are then grown on top of the metal layer. High-quality dielectrics are necessary to hold off electrical arcing between the conductive planes. The dielectric(s) can be many different materials. One embodiment that utilizes a well-known process in microelectronics is to deposit approximately 100 or more nanometers of silicon oxide and/or nitride with a relatively low temperature (about 300° C.) plasma assisted chemical vapor deposition (CVD) process in a clean room environment. Another well-known process that can also create high-quality dielectric's on top of conductors is patterned ion-implantation of dopants in silicon to make particular regions in the silicon conductive, through a layer of thermally grown silicon dioxide. The thermal oxide on top of the thin conductive silicon layer, after an anneal process, can provide an extremely good dielectric material.

The electrical leads connecting the conductive planes and the power supply can be made with the same metals, or with ion-implantation depending on the method used. The leads leaving the conductive planes are on the inner surfaces of the wafers, and the electrical contacts that connect the compressor 14 with the condenser insulator 12 and the evaporator insulator 16 are on the outer surfaces of the compressor assembly. To connect these leads, vias are etched through the wafer, and are metallized using one of several methods commonly used in the microelectronics industry, such as electroless plating solutions, or through ion-implantation.

Electrical connections from compressor to insulating layers can be made with solder bumps or conductive polymers. Solder bumps are used extensively in flip-chip bonding of silicon electronic devices. Solder bumps are preformed low-temperature solders that are wetted on metal pads. When brought into contact with another metal pad and heated, the solder flows and provides a solid electrical connection. Conductive polymers such as silver filled epoxies can be used in a similar manner.

The diaphragm that is situated between both compressor halves in the preferred embodiment is made from polymers and metals. The diaphragm is used in this embodiment to compress the refrigerant and for the two halves of the silicon wafer to bond to, and thus it must have a conductive plane within it, have a means to separate the conductive plane from other conductive planes on the surface of the wafer, should be compatible with a wide variety of refrigerants, and must be able to be bonded. One suitable structure for the diaphragm is to employ a central structural layer of polymer, with thin conductive metal layers evaporated and patterned on each side, with a thin coating of adhesive polymer dielectric layers as the outer most surface. Such layered thin film structures are commonly used in several industries, such as food packaging. Several potential polymeric materials meet all the criteria and are suitable for the central layer, including polyimide, thermosetting polyester, and liquid crystalline polyesters. One technique utilizes a thin sheet of polyimide obtainable from Dupont with heat sealable outer layers for the central layer. The polyimide is then metallized with three very thin layers of chrome/aluminum/chrome, which are patterned to the desired shapes to correspond with the mating conductive planes in the wafers, and then is coated on both sides with a very thin layer of thermosetting polyester and is cured. Any openings or reliefs that must be made through the diaphragm for ports, vias, and valves can be either etched or cut before assembly. Electrical connections can be made between the silicon wafer and the diaphragm by leaving metal pads exposed at the surface of the diaphragm, which when aligned would be coincident with a corresponding metal pad on the wafer. Either by using solder bumps or conductive polymer which are placed on the wafer pads before bonding, as described above, a solid electrical connection can be made when the compressor assembly is bonded together.

The diaphragm is assembled with the compressor halves by aligning the openings and patterns with their respective counterparts in the wafer. To prepare the compressor halves for bonding with the diaphragm, a very thin layer of thermosetting polyester can be applied to the mating surfaces of the wafer and cured with heat, forming chemical bonds with the underlying materials. Once the coated halves are brought together with the diaphragm between them, contact, pressure, and heating, the thermoset polyesters form a chemical bond providing high-strength bonds between the compressor halves. Liquid crystalline polyesters have similar properties and can be used in place of the thermosetting polyester and/or polyimide films. Other polymers and adhesives are potentially possible to use.

Final Assembly and Charging

Final assembly of the device involves aligning the heat exchanger assemblies with the compressor assembly. For the preferred embodiment, the compressor assembly is inserted in recess defined in the thermal insulators 12, 16 in the correct orientation, and the entire assembly is bonded together. If the condenser insulator 12 and the evaporator insulator 16 are made from thermosetting polyester, bonding is achieved by applying pressure and heat to form a chemical bond between the mating surfaces. If Kapton is used, an additional heat sealable polyimide layer that is machined with a recess is inserted between the layers for adhesion. Bonding can be done in a low-pressure atmosphere (vacuum) of an inert gas such as argon in order to reduce the heat transfer between the evaporator and condenser.

A port is provided in the condenser in the preferred embodiment for refrigerant to enter. An area around the port can be recessed, but must be bondable. To charge with refrigerant, the device is placed in a pressure vessel which is first evacuated of all non-refrigerant gases. Once evacuated, the vessel is pressurized with the desired refrigerant to a predetermined value at an elevated temperature such that all the refrigerant is a vapor. Vapor will flow to all parts of the device. While at the desired pressure and temperature, the entry port is sealed off. One means to seal off the port is to use a small patch of thermoset polyester, liquid crystalline polyester, or heat sealable polyimide, depending on the composition of the heat exchanger. Applying the appropriate heat and bond pressure, the port will become chemically bonded shut. After removal, the port area can be metallized for a vapor barrier and coated with protective polymer, along with the rest of the device if necessary. The pressure and temperature the charging vessel must be held at depends on the specific refrigerant used. Standard thermodynamic analysis may be employed to find the appropriate values that will produce the correct amount of charge required for normal operation.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A vapor-compression cycle heat transfer device comprising:

a flexible planar compressor diaphragm;

compressor wafers disposed on opposite sides of said diaphragm;

a compressor refrigerant inlet in one of said wafers;

a compressor refrigerant cavity in one of said wafers and in fluid communication with said compressor refrigerant inlet;

a compressor refrigerant outlet in one of said wafers and in fluid communication with said refrigerant cavity;

orifices in said diaphragm respectively positioned in fluid communication with said compressor refrigerant outlet and said compressor refrigerant inlet;

a condenser having a condenser refrigerant inlet in fluid communication with said compressor refrigerant outlet and having a condenser refrigerant outlet;

valve holes penetrating said diaphragm and said compressor wafers and in fluid communication with said condenser refrigerant outlet;

an evaporator having an evaporator refrigerant inlet in fluid communication with said valve holes and an evaporator refrigerant outlet in fluid communication with said condenser refrigerant inlet; and electrical contacts to stimulate movement of said diaphragm.

2. The device as defined in claim 1, further comprising a condenser insulator disposed between said condenser and said wafer having said compressor refrigerant outlet, said condenser insulator having separate orifices respectively in fluid communication with said valve holes and said compressor refrigerant outlet.

3. The device as defined in claim 2, further comprising electrical circuit patterns within said condenser insulator, an exposed interconnect from said electrical circuit patterns to one of said electrical contacts, and a device interconnect from said electrical circuit patterns to outside said device.

4. The device as defined in claim 2, wherein said condenser insulator includes a plurality of channels.

5. The device as defined in claim 4, further comprising an evaporator insulator disposed between said evaporator and said wafer having said compressor refrigerant inlet, said evaporator insulator having separate orifices respectively in fluid communication with said valve orifice and said compressor refrigerant inlet, said evaporator insulator having a plurality of channels generally orthogonal to the plurality of channels of said condenser insulator.

6. The device as defined in claim 1, further comprising an evaporator insulator disposed between said evaporator and said wafer having said compressor refrigerant inlet, said evaporator insulator having separate orifices respectively in fluid communication with said valve orifice and said compressor refrigerant inlet.

7. The device as defined in claim 6, further comprising electrical circuit patterns within said condenser insulator, an exposed interconnect from said electrical circuit patterns to one of said electrical contacts, and a device interconnect from said electrical circuit patterns to outside said device.

8. The device as defined in claim 1, wherein said electrical contacts comprise opposing capacitive electrical contacts on said cavity and said diaphragm.

9. The device according to claim 8, wherein said opposing capacitive contacts are separate conductive layers respectively formed on said cavity and said diaphragm.

10. The device as defined in claim 1, wherein both of said wafers include a refrigerant cavity.

11. The device as defined in claim 1, wherein said cavity comprises a generally circular depression with a raised center portion.

12. The device as defined in claim 1, wherein said condenser includes a plurality of fluid channels defining a flow path between said condenser inlet and said condenser outlet.

13. The device as defined in claim 1, wherein said evaporator includes a plurality of fluid channels defining a flow path between said evaporator inlet and said evaporator outlet.

14. The device as defined in claim 1, further comprising a cut out adjacent said valve holes in each of said diaphragm and said compressor wafers for thermally isolating said valve holes from said refrigerant cavity and said compressor inlet.

15. A vapor compression cycle heat transfer device comprising:

a layered compressor including a flexible diaphragm stimulated to move in response to capacitive electrical force, said compressor including refrigerant communication means for communicating refrigerant in a closed loop within said device in response to movement of said flexible diaphragm;

condenser means, forming part of said closed loop, for removing heat from refrigerant received from said compressor to adjacent atmosphere; and evaporator means, forming part of said closed loop, for absorbing heat from adjacent atmosphere into refrigerant received from said condenser means.

16. The device as defined in claim 15, wherein said refrigerant communication means include valve means defined within the flexible diaphragm for controlling flow of refrigerant into and out of said compressor.

17. The device as defined in claim 15, wherein effective compressive surface area of said flexible diaphragm is reduced during a cycle of refrigerant compression within said compressor.

18. The device as defined in claim 15, wherein said valve means open and close in response to movement of said flexible diaphragm.

19. The device as defined in claim 18, further comprising electric clamping means for clamping said valve means when said valve means close in response to movement of said flexible diaphragm.

20. The device as defined in claim 15, wherein said refrigerant communication means comprise a top cavity disposed above said diaphragm, a bottom cavity disposed below said diaphragm, and a plurality of channels and orifices for guiding refrigerant through said compressor on both sides of said diaphragm.

21. A vapor-compression cycle heat transfer device comprising:

an evaporator layer including evaporation fluid channels;

a condenser layer including condensation fluid channels;

a layered compressor disposed between said evaporator layer and said condenser layer, said compressor including a diaphragm layer between compressor wafers and defining a fluid cavity in at least one of said wafers; and a closed loop fluid flow path interconnecting and running through said evaporation fluid channels, condensation fluid channels and said fluid cavity.

22. The device defined in claim 21, wherein said evaporator layer and said condenser layer are approximately 100 mm in length and 100 m in width, and the device is approximately 2.5 mm in overall height.

* * * * *